US006752264B2

(12) United States Patent
Versluys

(10) Patent No.: US 6,752,264 B2
(45) Date of Patent: Jun. 22, 2004

(54) FLEXIBLE POUCH HAVING SYSTEM FOR MIXING TWO COMPONENTS

(75) Inventor: Robert Thor Versluys, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 190 days.

(21) Appl. No.: 10/188,703

(22) Filed: Jul. 3, 2002

(65) Prior Publication Data

US 2004/0004010 A1 Jan. 8, 2004

(51) Int. Cl.[7] ..... B65D 25/08

(52) U.S. Cl. ..... 206/219; 206/221; 383/38; 383/10; 383/104

(58) Field of Search ..... 206/219, 220, 206/221, 222, 216, 217; 383/38, 10, 80, 104; 222/94, 145.1

(56) References Cited

U.S. PATENT DOCUMENTS

| | | | | |
|---|---|---|---|---|
| 3,542,032 A | | 11/1970 | Spencer, Jr. | 128/399 |
| 3,741,383 A | | 6/1973 | Wittwer | 206/47 A |
| 4,608,043 A | | 8/1986 | Larkin | 604/87 |
| 4,609,369 A | | 9/1986 | Ball | 604/56 |
| 4,678,103 A | | 7/1987 | Dirksing | 222/130 |
| 4,730,381 A | | 3/1988 | Dirksing | 29/451 |
| 4,787,511 A | | 11/1988 | McIver | 206/219 |
| 4,793,475 A | | 12/1988 | Itzel | 206/221 |
| 4,950,237 A | | 8/1990 | Henault et al. | 604/82 |
| 4,952,068 A | | 8/1990 | Flint | 366/337 |
| 4,959,051 A | | 9/1990 | Glass et al. | 604/77 |
| 5,027,980 A | | 7/1991 | Bell | 222/94 |
| 5,052,590 A | | 10/1991 | Ratcliff | 222/94 |
| 5,257,986 A | * | 11/1993 | Herbert et al. | 604/416 |
| 5,318,203 A | * | 6/1994 | Iaia et al. | 222/94 |
| 5,407,278 A | | 4/1995 | Beer | 383/38 |
| 5,588,550 A | | 12/1996 | Meyer | 220/525 |
| RE35,540 E | * | 6/1997 | Davies et al. | 222/402.1 |
| 5,766,149 A | | 6/1998 | Kriesel et al. | 604/89 |
| 5,865,309 A | | 2/1999 | Futagawa et al. | 206/219 |
| 5,954,230 A | * | 9/1999 | Blette et al. | 222/1 |
| 6,000,848 A | | 12/1999 | Massioui | 383/80 |
| 6,047,817 A | | 4/2000 | Taylor et al. | 206/217 |
| 6,063,223 A | * | 5/2000 | Klauke et al. | 156/242 |
| 6,082,585 A | | 7/2000 | Mader et al. | 222/83 |
| 6,105,760 A | | 8/2000 | Mollstam et al. | 206/222 |
| 6,135,275 A | | 10/2000 | Kelders et al. | 206/221 |
| 6,161,729 A | | 12/2000 | Gentile et al. | 222/94 |
| 6,164,822 A | | 12/2000 | Beer | 383/38 |
| 6,223,942 B1 | | 5/2001 | Markey et al. | 222/94 |
| 6,254,907 B1 | | 7/2001 | Galomb | 426/115 |
| 6,257,428 B1 | | 7/2001 | Caola | 215/11.1 |
| 6,321,947 B2 | | 11/2001 | Gross et al. | 222/145.1 |

FOREIGN PATENT DOCUMENTS

| | | |
|---|---|---|
| WO | WO94/21535 | 9/1994 |

* cited by examiner

*Primary Examiner*—Jila M. Mohandesi
(74) *Attorney, Agent, or Firm*—Drinker Biddle & Reath LLP

(57) ABSTRACT

A pouch includes multiple chambers for separate containment of liquid components or liquid and dry components. A fitment having a bore is secured at an end of the pouch. The fitment also includes passages extending from a lower portion of the bore to the chambers to provide for fluid transfer therebetween. A closure includes a cap threadedly engaging an upper portion of the bore and a plug received by a lower portion of the bore to close the passages and prevent fluid transfer between the chambers. The plug including a breakable stem for separation between the plug and the cap. Engagement between the cap and the bore without the plug providing for mixture components within the pouch.

14 Claims, 6 Drawing Sheets

FLEXIBLE POUCH HAVING SYSTEM FOR MIXING TWO COMPONENTS

FIELD OF THE INVENTION

The present invention relates to flexible pouches and, more particularly, the present invention relates to flexible pouches that provide chambers for separate storage of liquid components or liquid and dry components.

BACKGROUND OF THE INVENTION

Flexible pouches are used for packaging a wide variety of consumer products. Many consumer products, such as hair coloring, cleaning and pharmaceutical products, for example, include components that require separate storage for mixing by the consumer prior to use. The use of individual packaging for the separate components, however, requires that a third container be used to package the product for handling and sale of the product to the ultimate consumer of the product. The additional packaging is used only for containing the individual packages and becomes disposable following removal of the individual component packages. The use of individual packaging for the separate components further necessitates that a vessel, such as a bowl, be used to mix the components. The use of a separate vessel for mixing, however, creates the potential for spillage and requires that the vessel be cleaned following use of the product.

Flexible pouches having multiple chambers for separate storage of product components are known. The inclusion of multiple chambers in the single package allows for handling of the product and delivery to an end user without the need for additional packaging. The reduction in the packaging required, therefore, serves to limit waste generated by the product. For use of the product, however, it is still required that the components be removed from the package into a separate vessel for mixing prior to use.

U.S. Pat. No. 4,608,043 to Larkin discloses a multiple chambered flexible package in which a separating barrier between two chambers includes a weakened section. Upon application of sufficient pressure to the contained substance of one the chambers, the weakened portion is designed to rupture to provide for mixing communication between the two chambers. Following mixing of the components, the product is delivered from the package through an access port provided at an end of the package. The weakened portion of the barrier wall, however, may be pressurized inadvertently during shipping and handling of the flexible package for example. Such premature rupturing of the barrier would likely result in waste of a product having components that require separation until immediately prior to use of the product.

SUMMARY OF THE INVENTION

The present invention provides a flexible pouch having first and second panels that are secured together along opposite sides of the pouch. The panels define a plurality of chambers for separate storage of multiple components by the pouch.

The pouch further includes a fitment secured to the panels at an end of the pouch. The fitment includes a bore having upper and lower portions. The fitment further includes a plurality of passages each extending from the lower portion of the bore to the chambers.

The pouch also includes a closure having a first portion sized and dimensioned for close interfit with the lower portion of the plug to prevent fluid transfer between the chambers. The first and second closure portions being connected by a frangible connection.

The frangible connection between the first and second closure portions providing for disengagement of the first closure portion from the bore for separation of the first closure portion from the second closure portion. Engagement of the second closure portion with the upper portion of the bore providing for mixing of the components within the pouch.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE PREFERRED EMBODIMENTS

Figure 1:
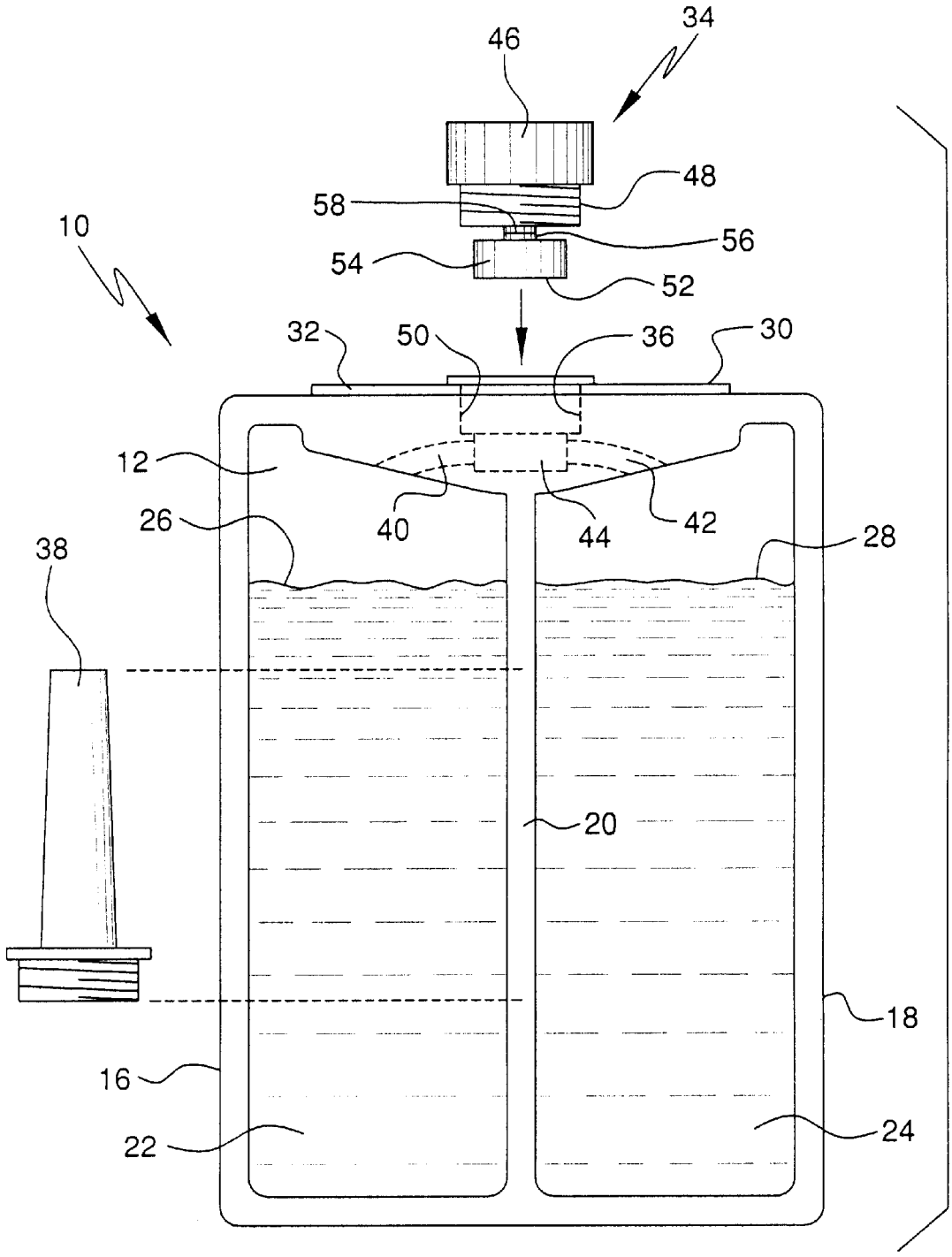
FIG. 1 is a front view of a pouch according to the present invention having a system for mixing multiple components contained in the pouch.

Referring to the drawings, where like numerals identify like elements, there is illustrated in FIG. 1 a flexible pouch 10 according to the present invention. The pouch 10 includes a front panel 12 and an opposite rear panel 14 (FIG. 6) secured together along opposite sides 16, 18, preferably by heat sealing. The front and rear panels 12, 14 are also heat sealed to each other along an intermediate line 20 extending parallel to the sides 16, 18 to define first and second chambers 22, 24. The chambers 22, 24 provide for separate storage of product components until the components are mixed in the manner to be described below. Pouch 10 is shown in FIG. 1 containing liquids 26, 28, respectively, in chambers 22, 24. A hair coloring formulation is an example of a product having multiple liquid components that are separately packaged until mixed by the consumer prior to use of the product. Alternatively, the pouch 10 could provide separate storage for a product having liquid and dry components, such as a pharmaceutical formulation for example.

A fitment 30 is located at an end of the pouch 10 to provide for closure of the separate chambers 22, 24. The front and rear panels 12, 14 of the pouch 10 are secured to side surfaces 32 of the fitment 30, preferably by heat sealing. The front and rear panels 12, 14 may also be secured to each other adjacent a lower edge of the fitment 30. A closure member 34 is engageable with a bore 36 of the fitment 30. The closure member 34, in the manner to be described, provides for separation of the liquids 26, 28 until mixing of the liquids is desired.

Figure 7:
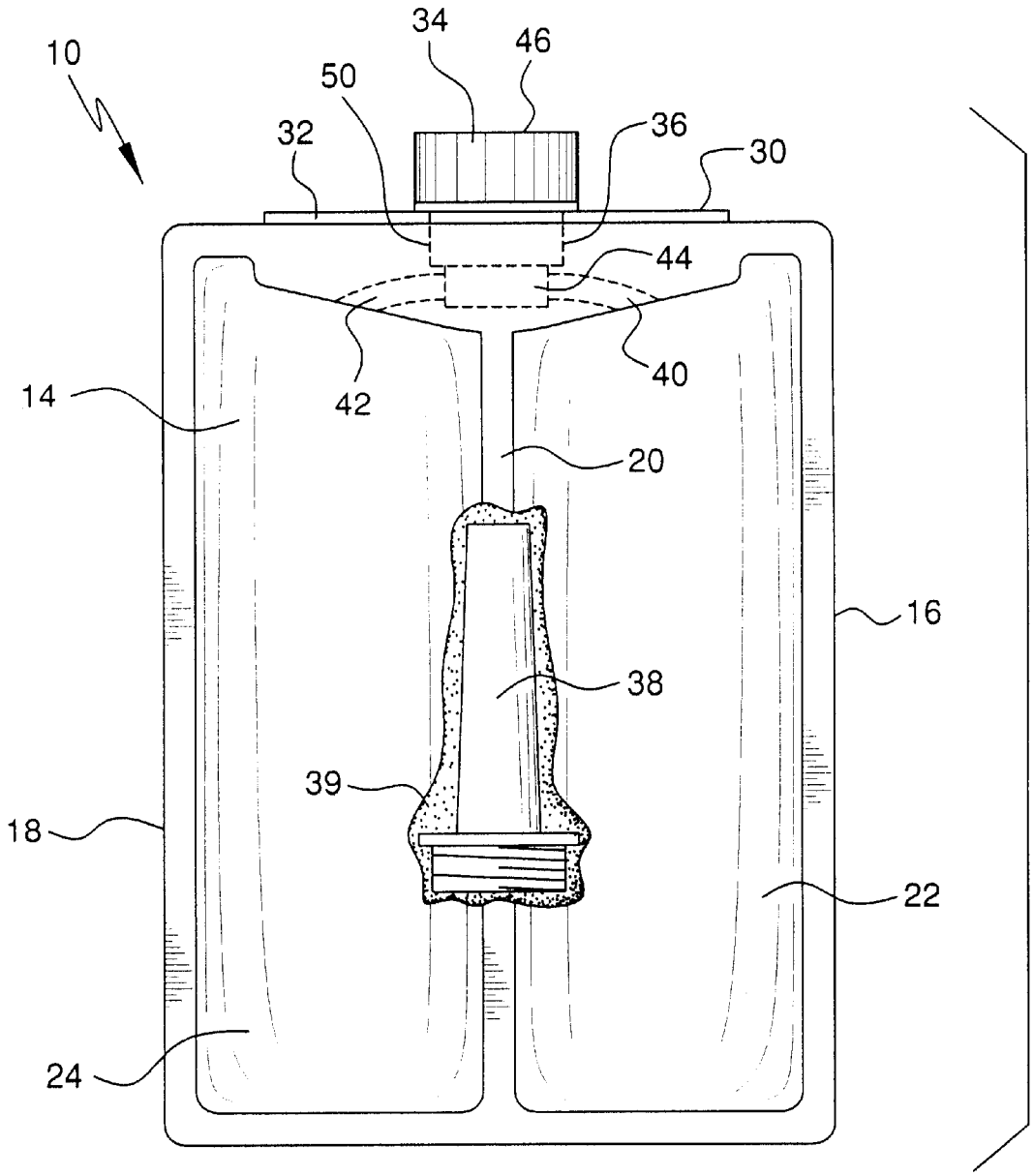
FIG. 7 is rear view of the pouch of FIG. 1 showing a dispensing attachment secured to the rear of the pouch.

A nozzled attachment 38 is engageable with the bore 36 of the fitment 30 to provide for dispensing of the contained product after the liquids 26, 28 have been mixed within the pouch 10. The nozzled attachment 38 is preferably contained in a suitable enclosure, such as a plastic container 39 (FIG. 7). The container 39 is secured to the rear panel 14 of the pouch 10, as shown, preferably by an adhesive material.

Figure 2:
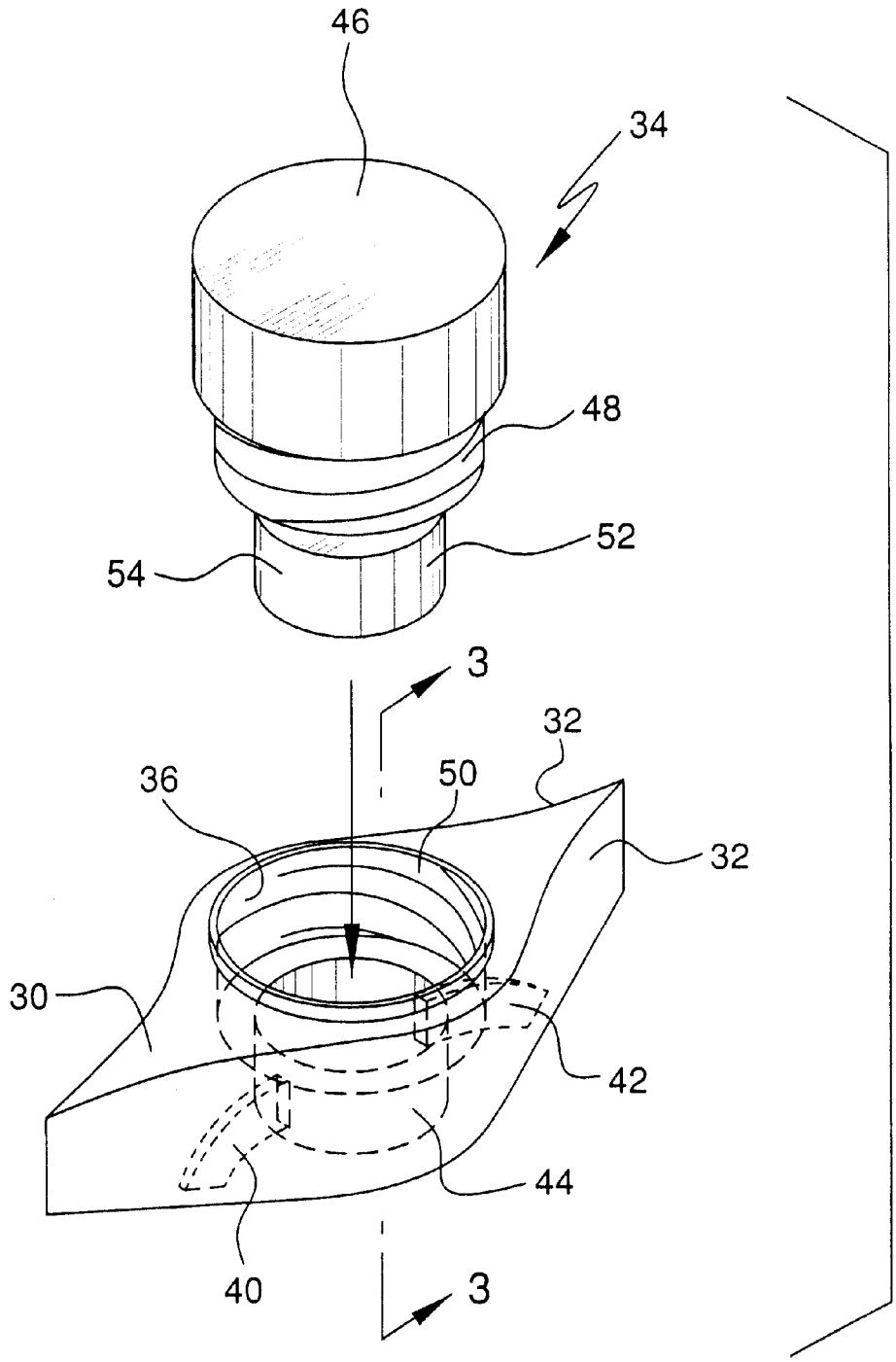
FIG. 2 is a perspective view of the fitment and closure member of the pouch of FIG. 1.
Figure 3:
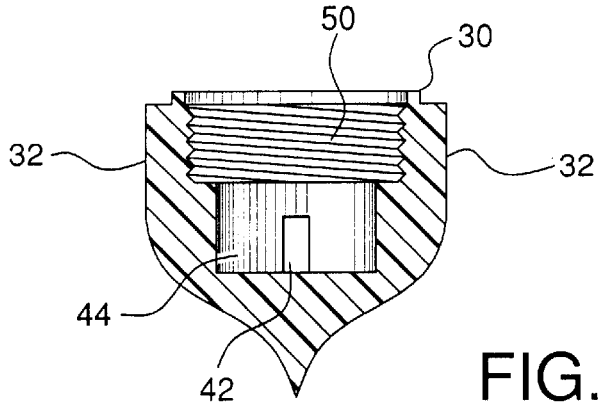
FIG. 3 is a sectional view taken along the lines 3—3 of FIG. 2.
Figure 4:
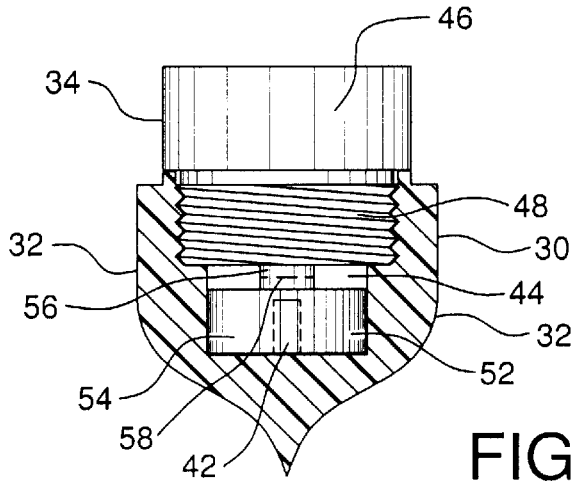
FIG. 4 is a side view, partly in section, showing the closure member of FIG. 2 engaging the fitment prior to removal of the plug portion of the closure member.
Figure 5:
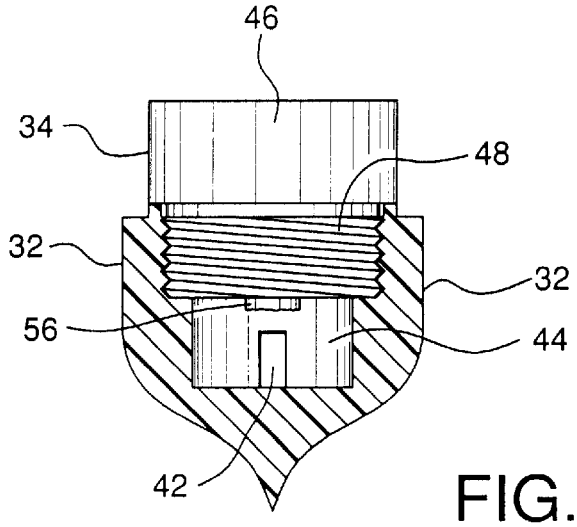
FIG. 5 is a side view, partly in section, showing the closure member of FIG. 2 engaging the fitment after removal of the plug portion.

Referring to FIGS. 2–5, the construction and operation of the fitment 30 and the closure member 34 is illustrated in greater detail. As shown in FIG. 2, the fitment 30 has a thickness that is maximum in a middle portion such that the fitment 30 is generally canoe-shaped. The fitment 30 includes passages 40, 42 extending in opposite directions from a lower portion 44 of the bore 36 to the lower edge of the fitment 30. The passages 40, 42 link the bore 36 to the chambers 22, 24 to provide for fluid transfer between the chambers 22, 24 through the fitment 30.

The closure member 34 includes a cap 46 having an externally threaded portion 48 engageable with an internally threaded upper portion 50 of the bore 36. The closure member 34 further includes a plug 52 attached to the cap 46. A lower portion 54 of the plug 52 is dimensioned for close interfit with the lower portion 44 of the bore 36. The engagement between the plug 52 and the bore 36 functions to seal the passages 40, 42 thereby preventing transfer of fluids between the chambers 22, 24.

The plug 52, preferably made from a soft rubber material, is adhered or welded to the cap 46, preferably made from a molded plastic material. As shown in FIG. 1, the plug 52 includes a reduced diameter portion 56 with respect to the lower portion 54. The reduced diameter portion 56 functions as a frangible stem that is adapted to be broken by a user to provide for mixing of components between the chambers 22, 24 in the manner described below. The reduced diameter stem 56 includes a score line 58 to facilitate separation of the lower portion 54 of the plug 52 from the cap 46. The reduced diameter portion 56, however, should possess sufficient strength to provide for initial engagement of the plug 52 with the lower portion 44 of bore 36 to seal the chambers 22, 24 as the cap 46 engages the upper portion 50 of the bore 36.

The pouch 10 is designed for mixing and delivery of separate components in the following manner. As shown in FIG. 1, the liquid components 26, 28 are proportioned with respect to the chambers 22, 24 such that neither of the chambers is completely filled. The space provided in the chambers 22, 24 in this manner facilitates transfer of fluid between the chambers 26, 28 to provide for mixing of the components 26, 28.

To provide for mixing of the components 26, 28 by fluid transfer through the fitment 30, a user disengages the closure member 34 form the fitment 30 by unthreading the cap 46 from the upper portion 50 of the bore 36. The user then separates the plug 52 from the cap 46 by twisting the lower portion 54 of the plug 52 with respect to the cap 46. The twisting of the lower portion 54 severs the lower portion 54 from the cap 46 along the score line 58. The cap 46 is then threaded into the bore 36 without the plug 52. The engagement of the cap 46 with the bore 36, without the plug 52, provides a condition in which the chambers 22, 24 are in fluid communication through the bore 36 while the bore is closed by the cap 46.

Figure 6:
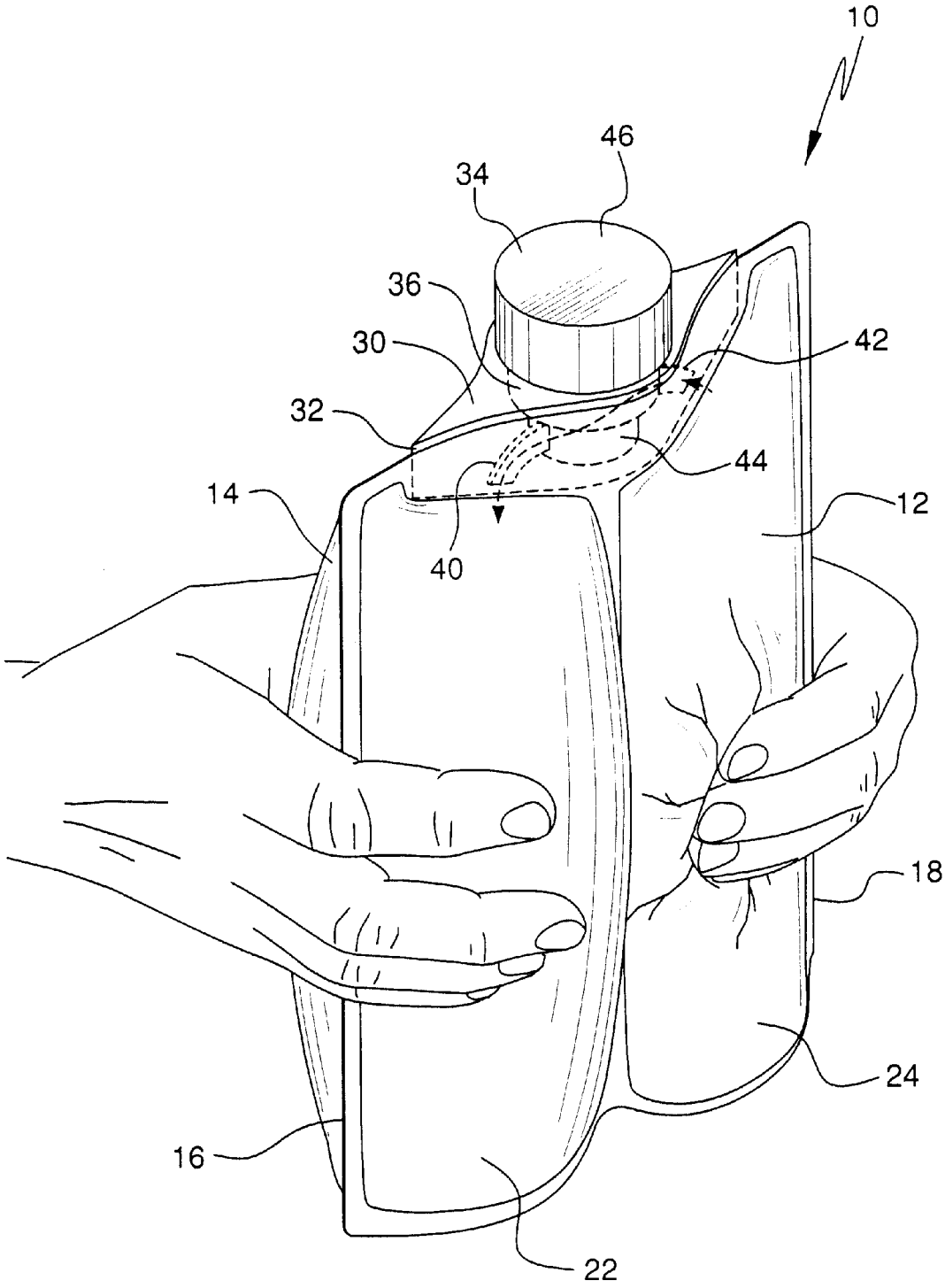
FIG. 6 is a perspective view of the pouch of FIG. 1 shown being used to mix components of separate compartments through the fitment.

To mix the components 26, 28, a user applies pressure to the chambers 22, 24, as shown in FIG. 6, in an alternating fashion such that liquid is transferred back and forth between the chambers 22, 24 through the fitment 30. The fluid transfer between the chambers 22, 24 mixes the liquid components 26, 28. To facilitate mixing, the liquids 26, 28 desirably possess sufficiently low viscosity such that the liquids easily pass between the chambers 22 24 through the passages 40, 42 of the fitment 30. One of the front and rear panels 12, 14 may be made from a transparent material to facilitate visual examination of the components 26, 28 within chambers 22, 24 for determining when sufficient mixing of the components 26, 28 has occurred.

The product is discharged from the pouch 10 following sufficient mixing of the components 26, 28 as follows. The closure member 34 is disengaged from the fitment 30 to provide an exit path for the mixed components 26, 28 from the pouch 10 via the passages 40, 42 and the bore 36. The pouch 10 may then be inverted and pressure applied to the chambers 22, 24 by a user for discharge of the mixed components 26, 28. To facilitate discharge of the mixed components 26, 28 in a controlled manner, a user removes the nozzled attachment 38 from the container 38 secured to the rear panel 14 and threads the attachment 38 into the upper portion 50 of bore 36.

Figure 8:
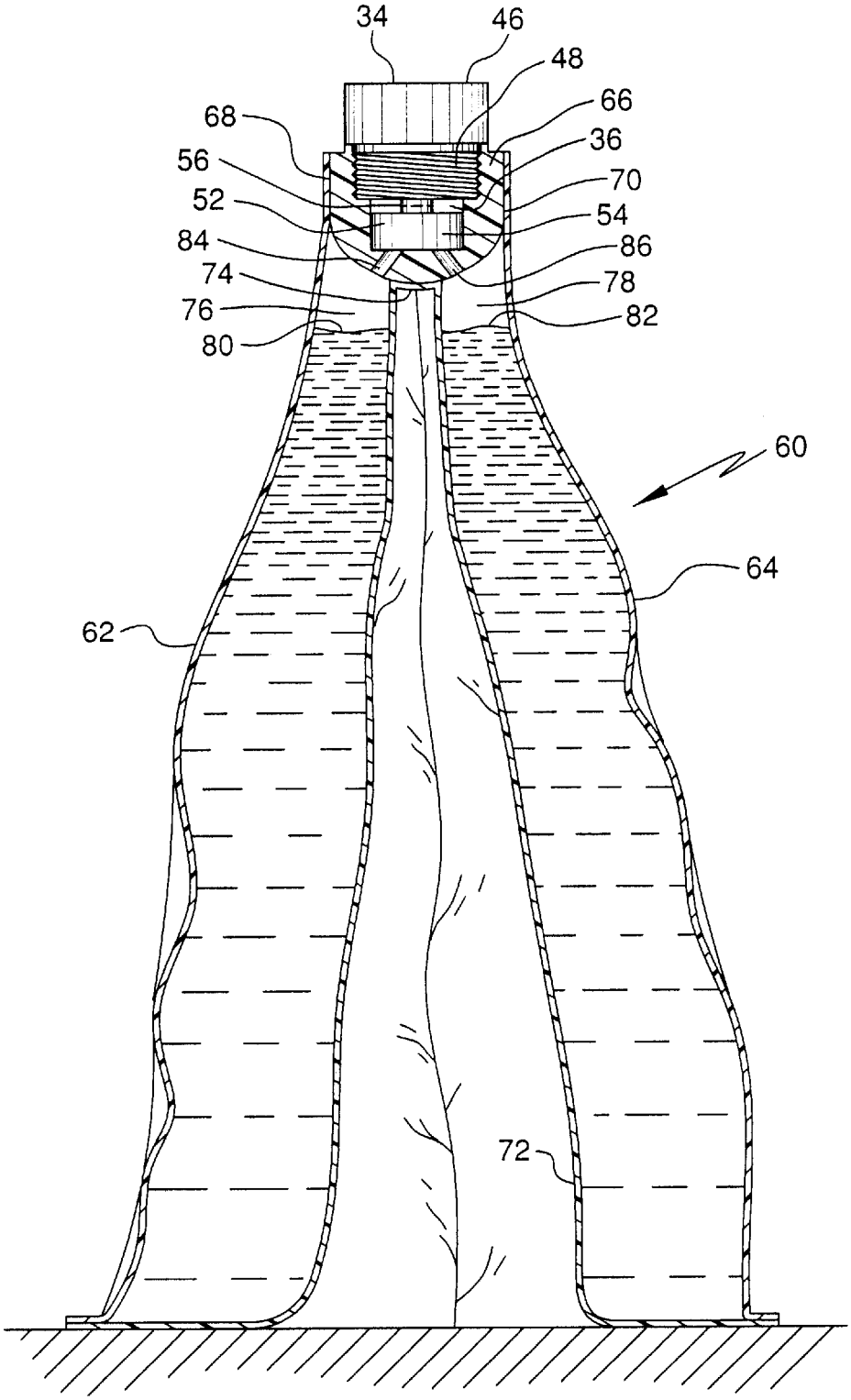
FIG. 8 is a side view, partly in section, of a stand-up pouch according to the present invention.

Referring to FIG. 8, there is shown a pouch 60 according to a second embodiment of the present invention. The pouch 60 includes first and second panels 62, 64 secured to each other along opposite sides of the panels, in a similar fashion to the front and rear panels 12, 14 of pouch 10. The first and second panels 62, 64 are also secured to first and second surfaces 68, 70, respectively, of a fitment 66.

The pouch 60 further includes a third panel 72 secured to the first and second panels 62, 64. The connection of the third panel 72 to the first and second panels 62, 64 provides for self-support of the pouch 60. As shown, the third panel 72 extends upwardly between the first and second panels 62, 64 to a central fold 74 that is secured to a lower portion of the fitment 66 between the first and second panels 62, 64. The bottom of the fitment 66 differs from the generally pointed bottom of fitment 30 and is, instead, rounded to facilitate the securing of the central fold 74 of third panel 72 to the fitment 66. The connection of the third panel 72 to the pouch 60 in this manner divides the interior of the pouch 60 into first and second chambers 76, 78. The chambers 76, 78 differ from the chambers 22, 24 of pouch 10 because the chambers 76, 78 are located forwardly and rearwardly of each other rather than in a side-by-side fashion as was the case with chambers 22, 24. The chambers 76, 78 are shown containing liquid components 80, 82. As was the case with pouch 60, however, the chambers 76, 78 of pouch 60 could alternatively contain a product such as a pharmaceutical product having a liquid and a dry component.

The pouch 60 includes a closure member 34 received in a bore 36 of the fitment 66. The closure member 34, similar to the closure member 34 of pouch 10, includes a cap 46 threadedly engaged to the bore 36 and a removable plug 52 for sealing a lower portion of the bore 36.

The fitment 66 includes first and second passages 84, 86 extending from the bore 36. The first and second passages 84, 86 extend in opposite directions to communicate with the first and second chambers 76, 78, respectively. The orientation of the passages 84, 86 of pouch 60 is generally perpendicular to that of passages 40, 42 to provide for communication with the forwardly and rearwardly located chambers 76, 78. Otherwise the passages 84, 86 function similarly to passages 40, 42 to provide for fluid communication between the chambers 76, 78 through the bore 36 following removal of plug 52 from the closure member 34. To transfer fluid between the chambers 76, 78 of pouch 60, a user can apply pressure to the chambers 76, 78 through the bottom of the pouch 60.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather should be construed in breadth and scope in accordance with the recitation of the appended claims.

What is claimed is:

1. A pouch comprising:

first and second flexible panels secured together along opposite sides of the panels, the first and second panels defining first and second chambers for containment of first and second components of which at least one is a fluid;

a fitment secured to the first and second panels, the fitment including a bore having first and second portions, the first portion of the bore having a diameter, the second portion of the bore defining an open end, the fitment further including first and second passages extending between the first bore portion and the first and second chambers, respectively, such that a pathway is defined between the first and second chambers for passage of fluid therebetween; and a closure having a first portion adapted for engagement with the first bore portion, at least part of the first closure portion having a diameter substantially equal to the diameter of the first bore portion such that engagement between the first closure portion and the first bore portion closes the passages thereby preventing passage of fluid between the first and second chambers, the closure further including a second portion having an end to which the first closure portion is connected, the second closure portion adapted for engagement with the second bore portion to close the open end of the bore, the connection between the first and second closure portions being frangible such that a user can disengage the closure from the bore and separate the first and second closure portions from each other, the subsequent engagement of the second closure portion and the second bore portion without the first closure portion providing for fluid passage between the chambers via the pathway for mixture of the first and second components within the pouch.

2. The pouch according to claim 1 wherein the first and second panels are further secured together between the first and second chambers along a line extending generally parallel to the opposite sides of the panels.

3. The pouch according to claim 1 wherein the fitment has a thickness that is maximum in a middle portion of the fitment and wherein the bore is located in the middle portion of the fitment.

4. The pouch according to claim 1 wherein the first and second passages of the fitment extend from opposite sides of the first bore portion.

5. The pouch according to claim 1 wherein the second closure portion includes a plug and a stem, the stem secured to the first closure portion and having a reduced cross section with respect to the plug to provide for separation of the plug from the closure by fracture of the stem caused by relative rotation between the plug and the first closure portion.

6. The pouch according to claim 5 wherein the stem includes a score line to facilitate fracture of the stem.

7. The pouch according to claim 1 further comprising a third panel, the third panel providing for self-standing support of the pouch.

8. The pouch according to claim 1 wherein at least one of the first and second panels is transparent to provide visual inspection of components contained in the chambers.

9. A flexible container for storing a product having multiple components requiring mixture prior to use, the container comprising:

front and rear panels secured together, the panels defining a plurality of chambers for containment of multiple components;

a fitment having opposite sidewalls to which the front and rear panels are secured and opposite top and bottom ends, the fitment including a bore having an upper portion adjacent the top end and a lower portion, the fitment further including a plurality of passages each extending between the lower portion of the bore and one of the chambers;

a plug sized and dimensioned for close interfit with the lower portion of the bore to prevent transfer of the contained components between the chambers; and a cap engageable with the upper bore portion, the cap connected to an upper end of the plug to provide for removal of the plug from the bore, the connection between the plug and the cap being breakable to provide for separation of the removed plug from the cap, engagement of the cap to the upper portion of the bore without the plug providing for fluid transfer between the chambers for mixing the components within the container.

10. The container according to claim 9 wherein the fitment is adhesively secured to the panels.

11. The container according to claim 9 wherein the engagement between the cap and the bore is provided by external and internal threads formed respectively on the cap and the upper bore portion.

12. The container according to claim 9 wherein the plug includes a first portion adapted for interfit with the lower portion of the fitment bore adjacent the passages, the plug further including a second portion having a reduced cross section with respect to the first portion.

13. The container according to claim 9 wherein the breakable connection between the plug and the cap is provided by a stem having a reduced cross section with respect to the plug, the reduced cross section of the stem providing for separation of the cap from the plug when sufficient torque is applied to the stem.

14. A flexible mixing pouch comprising:

first and second panels secured together along opposite sides of the panels, the panels defining a plurality of chambers for separate containment of components that includes at least one fluid;

a fitment secured to the panels, the fitment including a bore having upper and lower portions, the fitment member further including a plurality of passages each extending between the lower bore portion and one of the chambers; and a closure member including first and second portions joined by a frangible connector, the frangible connector adapted to break in response to a predetermined torque applied thereto such that the first and second portion are separated from each other, the first closure member portion receivable within the lower bore portion and dimensioned for close interfit therewith such that transfer of fluid between the chambers is prevented, the second closure member portion engageable with the upper bore portion to provide for closure of an open end thereof, the predetermined breaking torque of the connector being sufficiently large to allow for engagement and disengagement between the closure member and the bore without separation between the first and second closure member portions resulting, the engagement of the second closure member portion to the bore after the predetermined breaking torque has been applied to the connector of a disengaged closure member to separate the closure member portions providing for fluid transfer between the chambers through the lower bore portion.

* * * * *